US011642885B2

(12) United States Patent
Cumbie et al.

(10) Patent No.: US 11,642,885 B2
(45) Date of Patent: May 9, 2023

(54) FLUID EJECTION DEVICE INCLUDING FLUID OUTPUT CHANNEL

(71) Applicant: HEWLETT-PACKARD DEVELOPMENT COMPANY, L.P., Houston, TX (US)

(72) Inventors: Michael W Cumbie, Albany, OR (US); Chien-Hua Chen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/916,520

(22) Filed: Jun. 30, 2020

(65) Prior Publication Data

US 2020/0331264 A1 Oct. 22, 2020

Related U.S. Application Data

(63) Continuation of application No. 16/318,517, filed as application No. PCT/US2016/059864 on Nov. 1, 2016, now Pat. No. 10,723,128.

(51) Int. Cl.
*B41J 2/14* (2006.01)
*B41J 2/16* (2006.01)

(52) U.S. Cl.
CPC ..... *B41J 2/14145* (2013.01); *B41J 2/1404* (2013.01); *B41J 2/14032* (2013.01); *B41J 2/1601* (2013.01); *B41J 2202/12* (2013.01)

(58) Field of Classification Search
CPC .. B41J 2/14145; B41J 2/14031; B41J 2/1404; B41J 2/04525; B41J 2/055; B41J 2/1433; B41J 2/14153; B41J 2/18; B41J 2/19; B41J 2/1408; B41J 2002/14419
See application file for complete search history.

(56) References Cited

U.S. PATENT DOCUMENTS

| | | | | |
|---|---|---|---|---|
| 6,244,694 | B1 * | 6/2001 | Weber et al. | B41J 2/055 |
| 6,283,584 | B1 | 9/2001 | Powers et al. | |
| 6,325,488 | B1 | 12/2001 | Beerling et al. | |
| 8,657,420 | B2 | 2/2014 | Hoisington et al. | |
| 8,820,899 | B2 | 9/2014 | Hoisington et al. | |
| 8,998,388 | B2 | 4/2015 | Cattaneo et al. | |
| 9,090,084 | B2 | 7/2015 | Govyadinov | |
| 9,211,721 | B2 | 12/2015 | Govyadinov et al. | |
| 10,112,387 | B2 * | 10/2018 | Moriya et al. | B41J 2/1404 |

(Continued)

FOREIGN PATENT DOCUMENTS

| | | |
|---|---|---|
| CN | 103502013 | 1/2014 |
| CN | 103826860 | 5/2014 |

(Continued)

OTHER PUBLICATIONS

Xaar's Hydra ink supply solution ensures optimal performance and reliability, Jan. 1, 2016, <http://www.xaar.com/en/MediaDocuments/Xaar-Hydra-Ink-Supply-System.pdf>.

*Primary Examiner* — Erica S Lin
(74) *Attorney, Agent, or Firm* — Foley & Lardner LLP

(57) ABSTRACT

A fluid ejection die includes an ejection nozzle and an ejection chamber fluidly connected to the ejection nozzle. The die includes a fluid input hole fluidly connected to the ejection chamber, a fluid output hole, and a fluid output channel fluidly connected to the ejection chamber and the fluid output hole. The die includes a fluid circulation rib positioned between the fluid input hole and the fluid output hole.

19 Claims, 7 Drawing Sheets

(56) References Cited

U.S. PATENT DOCUMENTS

| | | | | |
|---|---|---|---|---|
| 2002/0180835 | A1 | 12/2002 | Boyd et al. | |
| 2012/0007921 | A1 | 1/2012 | Govyadinov et al. | |
| 2013/0061962 | A1* | 3/2013 | Kornilovich | B01L 3/50273 137/565.17 |
| 2013/0169710 | A1 | 7/2013 | Keefe et al. | |
| 2013/0321541 | A1 | 12/2013 | Govyadinov | |
| 2014/0313264 | A1 | 10/2014 | Cattaneo et al. | |
| 2015/0049141 | A1 | 2/2015 | Taff | |
| 2015/0239241 | A1 | 8/2015 | Maher | |
| 2015/0306875 | A1* | 10/2015 | Nishimura | B41J 2/14274 347/71 |

FOREIGN PATENT DOCUMENTS

| | | | |
|---|---|---|---|
| JP | 2008073898 | A | 4/2008 |
| JP | 2012011629 | | 1/2012 |
| JP | 2014514190 | | 6/2014 |
| JP | 2014531349 | | 11/2014 |
| JP | 2015058581 | | 3/2015 |
| JP | 2016107418 | | 6/2016 |
| RU | 2203808 | C2 | 5/2003 |
| WO | WO-2009143362 | | 11/2009 |
| WO | WO-2011146069 | | 11/2011 |
| WO | WO-2011146149 | | 11/2011 |
| WO | WO-2012054017 | | 4/2012 |
| WO | WO-2013162606 | | 10/2013 |

* cited by examiner

FLUID EJECTION DEVICE INCLUDING FLUID OUTPUT CHANNEL

BACKGROUND

Fluid ejection devices are devices that deposit a fluid, such as ink, on a medium, such as paper. A fluid ejection device may be connected to a fluid reservoir. Accordingly, fluid from the reservoir may be conveyed to the fluid ejection device and expelled, dispensed, and/or ejected therefrom.

Figure 1:
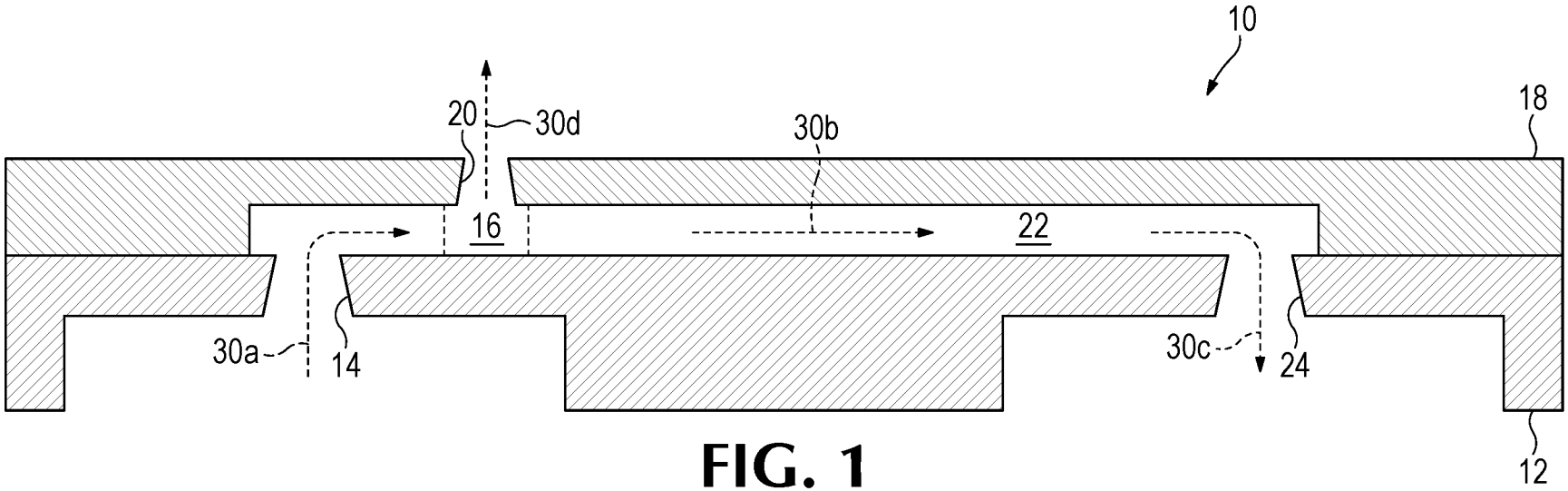
FIG. 1 is a block diagram that illustrates some components of an example fluid ejection die.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION

Examples of fluid ejection devices and fluid ejection dies thereof may comprise an ejection nozzle, an ejection chamber, a fluid input hole, a fluid output hole, a fluid output channel, and a fluid pump. The fluid input hole may be fluidly connected to the ejection chamber such that fluid may be conveyed to the ejection chamber via the fluid input hole. As will be appreciated, the fluid input hole may be fluidly connected to a fluid reservoir, and fluid from the fluid reservoir may be conveyed to the ejection chamber via the fluid input hole. In some examples, a fluid slot may be fluidly connected to the fluid reservoir and the fluid input hole. The ejection nozzle may be fluidly connected to and adjacent to the ejection chamber such that fluid in the ejection chamber may be ejected from the fluid ejection device via the ejection nozzle. Furthermore, the ejection chamber may be fluidly connected to the fluid output hole via the fluid output channel. The fluid pump is disposed in the fluid output channel. In such examples, fluid in the ejection chamber may be pumped from the ejection chamber out of the fluid output hole via the fluid output channel with the fluid pump.

Therefore, in such examples, the fluid ejection device may eject fluid in the ejection chamber via the ejection nozzle or the fluid ejection device may pump fluid from the ejection chamber out of the fluid output hole via the fluid output channel with the fluid pump. In some examples, the fluid output hole and fluid input hole may be fluidly connected to a common fluid slot. Accordingly, in these examples, fluid may be conveyed to the ejection chamber from the fluid slot via the fluid input hole, and the fluid in the ejection chamber may be conveyed to the fluid slot via the fluid output channel and fluid output hole. As will be appreciated, these examples may circulate fluid from the fluid slot, through the ejection chamber, and back into the fluid slot. Moreover, in these examples, the circulation of fluid may be performed in a single flow direction. In other words, the fluid input hole may facilitate conveyance of fluid to the ejection chamber from the fluid slot. The fluid output channel and fluid pump disposed therein may facilitate conveyance of fluid from the ejection chamber to the fluid slot via the fluid output hole.

Examples described herein may facilitate improved fluidic response of a fluid ejection device. In some examples, a fluid of the fluid ejection device may have a high concentration of particulate such that, without circulation thereof, the particulate may settle. For example, particulate of a fluid may settle in the ejection chamber. Settling of particulate in the ejection chamber may lead to clogging of the ejection nozzle or undesirable fluidic response. Accordingly, examples described herein may facilitate circulation of fluid through ejection chambers thereof such that particulate settling may be reduced.

In some examples, the fluid ejection device may comprise a fluid ejector including a heating element. To eject fluid via the ejection nozzle, the heating element may be electrically activated. Activation of the heating element may cause a vapor bubble to form in fluid proximate the fluid ejector, and the vapor bubble may cause ejection of a fluid drop out of the ejection nozzle. In such examples, it will be appreciated that operation of the fluid ejector may increase thermal profiles of fluid, components, and surfaces proximate the fluid ejector. Therefore, in examples including a fluid ejector including a heating element, circulating fluid through the ejection chamber may facilitate thermal cooling of the ejection chamber. It will be appreciated that even if a heating element is not implemented in a fluid ejector, circulation of fluid through the ejection chamber may reduce a temperature of components and surfaces.

In general, ejection nozzles may eject/dispense fluid from a fluidly connected ejection chamber. Nozzles generally include fluid ejectors to cause fluid to be ejected/dispensed from a nozzle orifice. Some examples of types of fluid ejectors implemented in fluid ejection devices include thermal ejectors, piezoelectric ejectors, and/or other such ejectors that may cause fluid to be ejected/dispensed from a nozzle orifice.

Moreover, examples described herein may be described as comprising nozzles, ejection chambers, fluid channels, fluid input holes, and/or fluid output holes. It will be appreciated that examples provided herein may be formed by performing various microfabrication and/or micromachining processes on a substrate to form and/or connect structures and/or components. The substrate may comprise a silicon based wafer or other such similar materials used for microfabricated devices (e.g., glass, gallium arsenide, metals, ceramics, plastics, etc.). Examples may comprise fluid channels, fluid actuators, volumetric chambers, nozzle orifices, or any combination thereof. Fluidic channels, nozzles, holes, and/or chambers may be formed by performing etching, microfabrication (e.g., photolithography), micromachining processes, or any combination thereof in a substrate. Accordingly, fluid channels, nozzle orifices, fluid input/output holes, and/or chambers may be defined by surfaces fabricated in the substrate and/or fabricated layers of a microfabricated device.

In some examples, fluid ejection dies may be referred to as slivers. Generally, a sliver may correspond to an ejection die having: a thickness of approximately 650 μm or less; exterior dimensions of approximately 30 mm or less; and/or a length to width ratio of approximately 3 to 1 or larger. In some examples, a length to width ratio of a sliver may be approximately 10 to 1 or larger. In some examples, a length to width ratio of a sliver may be approximately 50 to 1 or larger. In some examples, ejection dies may be a non-rectangular shape. In these examples a first portion of the ejection die may have dimensions/features approximating the examples described above, and a second portion of the ejection die may be greater in width and less in length than the first portion. In some examples, a width of the second portion may be approximately 2 times the size of the width of the first portion. In these examples, an ejection die may have an elongate first portion along which ejection nozzles may be arranged, and the ejection die may have a second portion upon which electrical connection points for the ejection die may be arranged.

Example fluid ejection devices and fluid ejection dies thereof, as described herein, may be implemented in printing devices, such as two-dimensional printers and/or three-dimensional printers (3D). As will be appreciated, some example fluid ejection devices may be printheads. In some examples, a fluid ejection device may be implemented into a printing device and may be utilized to print content onto a media, such as paper, a layer of powder-based build material, reactive devices (such as lab-on-a-chip devices), etc. Example fluid ejection devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected.

In some examples, a printing device in which a fluid ejection device may be implemented may print content by deposition of consumable fluids in a layer-wise additive manufacturing process. Consumable fluids and/or consumable materials may include all materials and/or compounds used, including, for example, ink, toner, fluids or powders, or other raw material for printing. Furthermore, printing material, as described herein may comprise consumable fluids as well as other consumable materials. Printing material may comprise ink, toner, fluids, powders, colorants, varnishes, finishes, gloss enhancers, binders, and/or other such materials that may be utilized in a printing process.

Turning now to the figures, and particularly to FIG. 1, this figure provides a block diagram that illustrates some components of an example fluid ejection die 10. In this example, the fluid ejection die 10 comprises a substrate 12 having a fluid input hole 14 that is fluidly connected to an ejection chamber 16 formed in a nozzle layer 18. The ejection chamber 16 is positioned adjacent to and fluidly connected with an ejection nozzle 20 that is formed in the nozzle layer 18. In this example, the fluid ejection die 10 further comprises a fluid output channel fluidly connected to the ejection chamber 16, and the fluid output channel is further fluidly connected to a fluid output hole 24 that is formed in the substrate 12. While not shown in this block diagram, in some examples, the fluid ejection die may comprise a fluid pump disposed in the fluid output channel 22 to pump fluid from the ejection chamber 16 to the fluid output hole 24. Furthermore, some examples may comprise a fluid ejector disposed in the ejection chamber and proximate the ejection nozzle 20 to eject fluid from the ejection chamber 16 via the ejection nozzle 20.

In the example illustrated in FIG. 1, it will be noted that the fluid ejection die 10 is illustrated as comprising a substrate 12 and a nozzle layer 18. It will be appreciated that the substrate 12 and nozzle layer 18 may comprise different materials. For example, the substrate 12 may comprise silicon, and the nozzle layer 18 may comprise a polymer material. Other combinations of materials may be implemented in other examples. Furthermore, in some examples, the nozzle layer 18 and the substrate 12 may be formed of more than two different materials or a single material.

As shown in FIG. 1, example fluid flow directions 30*a-d* corresponding to the fluid ejection die 10 are provided. In this example, fluid may flow through the fluid input hole 14 to the ejection chamber 16, as shown with flow direction 30*a*. Furthermore, fluid may flow from the ejection chamber 16 through the fluid output channel 22 to the fluid output hole 24, as shown in flow directions 30*b-c*. Alternative to flowing through the fluid output channel 22 and out of the fluid output hole 24, fluid may be ejected from the ejection chamber 16 through the ejection nozzle 20, as provided in example fluid flow direction 30*d*.

FIGS. 2A-D provide block diagrams of some example arrangements of components of a fluid ejection device and/or a fluid ejection die thereof. In these examples, a fluid ejection die 50 comprises an ejection chamber 52. The fluid ejection die 50 further includes a fluid input hole 54 fluidly connected to the ejection chamber 52 with which fluid may be conveyed from a fluid source to the ejection chamber 52. The fluid ejection die 50 includes an ejection nozzle 56 fluidly connected to the ejection chamber 52, and the fluid ejection die 50 includes a fluid ejector 58 disposed in the ejection chamber 52. Furthermore, the ejection chamber 52 is fluidly connected to a fluid output channel 60, which is also fluidly connected to a fluid output hole 62.

In the examples of FIGS. 2A-D at least one fluid pump 64 is disposed in each fluid output channel 60. As discussed previously, the fluid ejector 58 may be actuated to cause ejection of a fluid drop from the ejection chamber 52 via the nozzle 56. The fluid pump 64 may be actuated to cause pumping of fluid from the ejection chamber 52 through the fluid output channel 60 and out of the fluid output hole 62. In some examples, the fluid pump 64 is positioned closer to the ejection chamber 52 as compared to the fluid outlet hole 62 to facilitate asymmetric pumping of fluid in the fluid output channel 60.

Figure 2A:
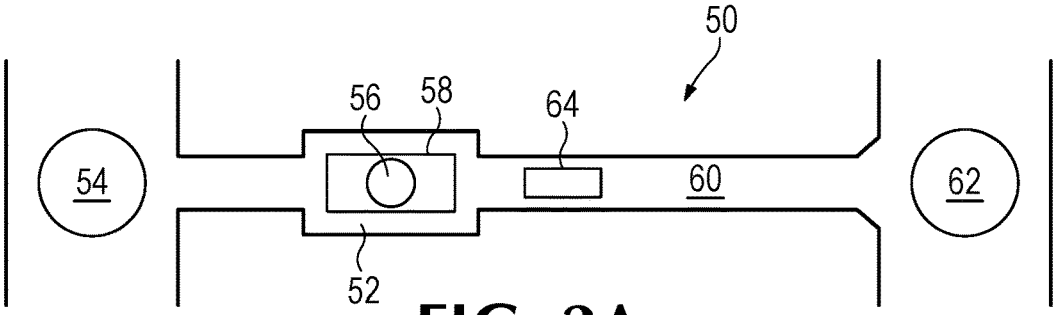
FIGS. 2A-D are block diagrams that illustrate some components of example fluid ejection dies.
Figure 2B:
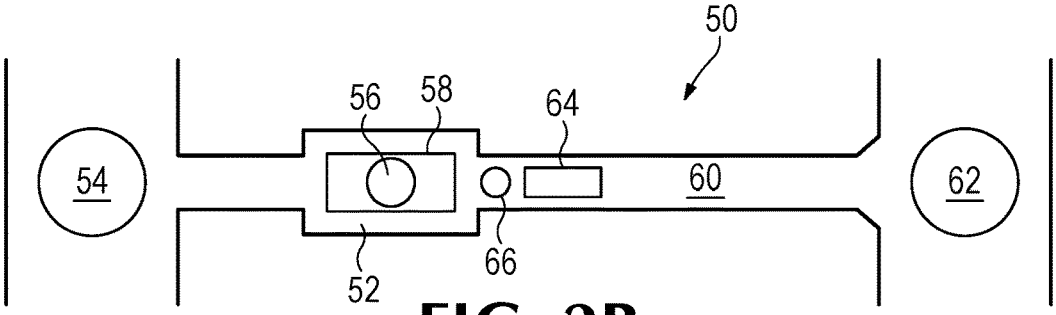
Figure 2C:
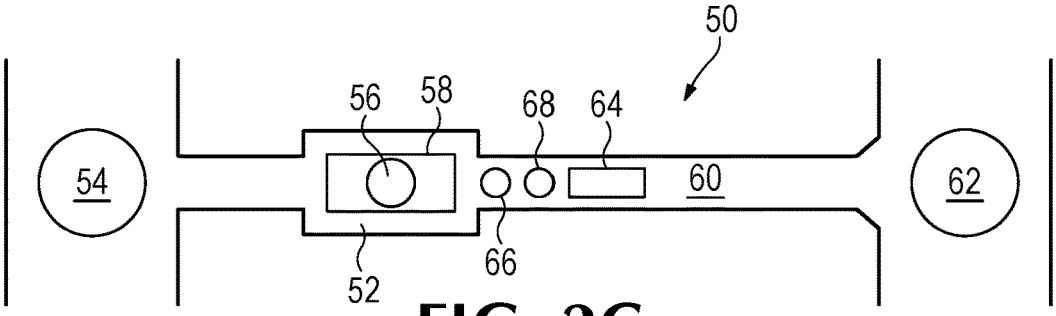

In the example of FIG. 2B, the example fluid ejection die 50 includes at least one pillar 66 disposed in the fluid output channel 60 and positioned between the ejection chamber 52 and the fluid pump 64. In FIG. 2C, the example fluid ejection die 50 includes at least two pillars 66, 68 disposed in the fluid output channel 60 and positioned between the ejection chamber 52 and the fluid pump 64. In the examples of FIGS. 2B-C, the pillars 668, 68 may reduce fluid cross-talk during actuation of the fluid pump 64 and/or fluid ejector 58.

Figure 2D:
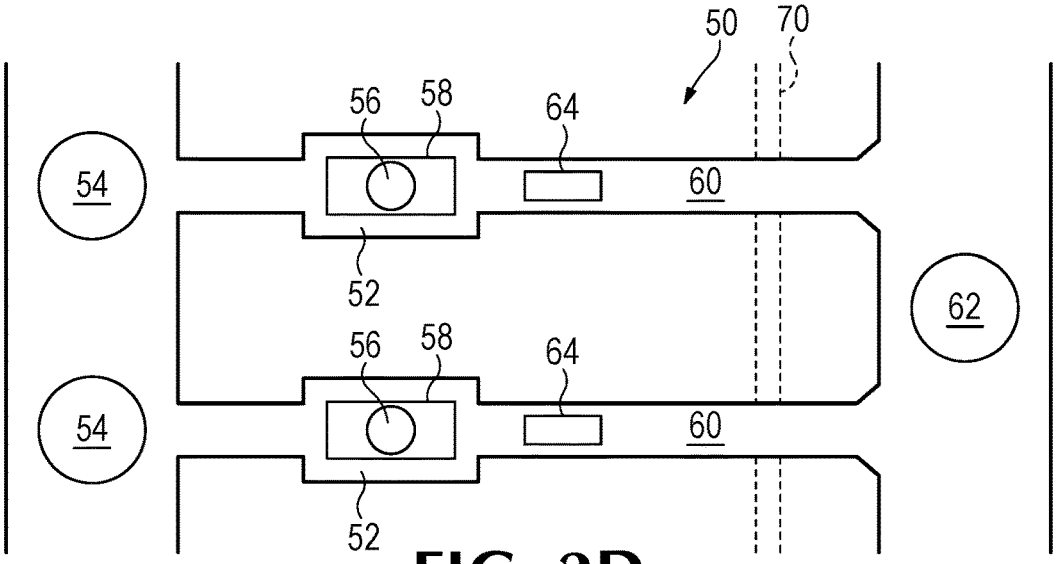

In the example of FIG. 2D, the fluid ejection die 50 comprises at least two fluid input holes 54, at least two ejection chambers 52, at least two ejection nozzles 56, at least two fluid ejectors 58, at least two fluid output channels 60, and at least two fluid pumps 64. As will be noted with regard to FIG. 2D, the fluid ejection die 50 comprises a single fluid output hole 62 that is fluidly connected to the two fluid ejection chambers 52 and the two fluid output channels 60. Therefore, in this example, fluid may be pumped from each ejection chamber 52 to the fluid output hole 62. FIG. 2D further illustrates a fluid circulation rib 70 (illustrated in phantom). As shown, the fluid circulation rib is positioned between the fluid input holes 54 and the fluid output hole 62. It will be appreciated that, in examples similar to the example of FIG. 2D, the fluid recirculation rib 70 may extend along a plane that is approximately orthogonal to a plane along which the fluid output channels 60, fluid input holes 54, and fluid output hole 62 may be formed. In such examples, fluid pumped through the fluid output hole 62 may be circulated in a direction approximately parallel to the plane along which the fluid circulation rib 70 extends until passing a point of termination of the fluid circulation rib 70. Accordingly, it may be appreciated that the fluid circulation rib 70 may inhibit drawing of fluid through a fluid input hole 54 that was output from the fluid output hole 62 until such output fluid has passed the point of termination of the fluid circulation rib 70.

It will be appreciated that the number of respective components illustrated in the examples of FIGS. 2A-D are merely for illustrative purposes. In other examples, the fluid ejection die may comprise more or less of each respective component (e.g., more or less ejection chambers, ejection nozzles, fluid pumps, fluid output channels, etc.). Furthermore, example fluid ejection dies may include other arrangements of such components with regard to number and relative arrangement therebetween.

Figure 3:
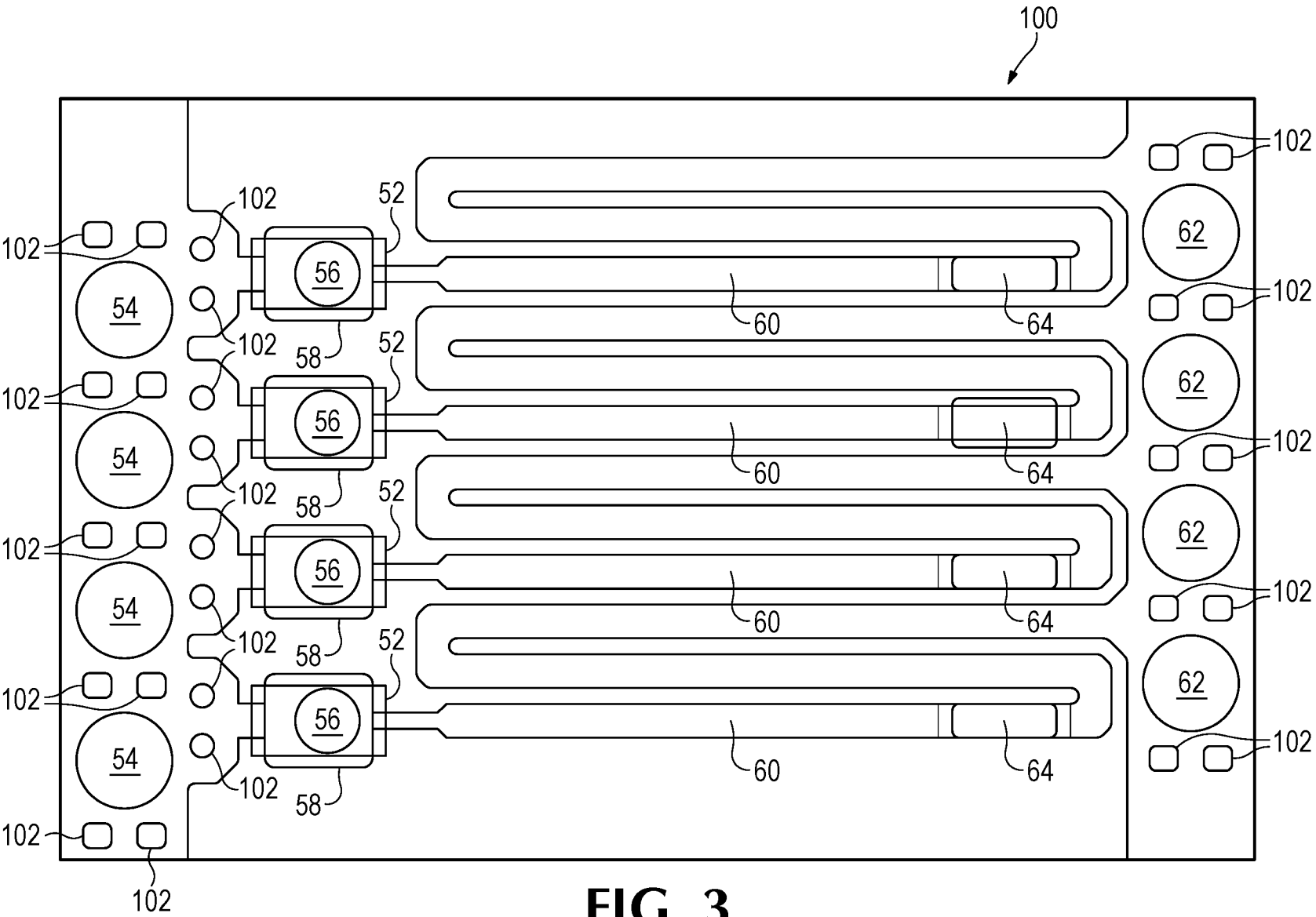
FIG. 3 is a block diagram of some components of an example fluid ejection die.

FIG. 3 provides a block diagram that illustrates some components of an example fluid ejection device and/or a fluid ejection die thereof. Similar to the examples of FIGS. 2A-D, the example fluid ejection die 100 includes ejection chambers 52, fluid input holes 54, ejection nozzles 56, fluid ejectors 58, fluid output channels 60, fluid output channels 60, fluid output holes 62, and fluid pumps 64. Furthermore, in the example of FIG. 3, the fluid ejection die includes pillars 102 positioned proximate the fluid input holes 54 and the fluid output holes 62. As will be appreciated, the pillars 102 may inhibit undesired particulate from entering the ejection chamber 52. Furthermore, in the example fluid ejection die 100, the fluid output channels 60 correspond to an S-shape. As used herein, an S-shape may indicate that the fluid output channel 60 includes two curves arranged between sections such that the fluid output channel 60 resembles the shape of the letter 'S'. In this example, the S-shaped fluid output channels 60 comprise straight sections connected by U-shaped curved sections. It will be appreciated that each respective fluid pump 64 may be positioned in the respective fluid output channel 60 at a position closer in distance to the respective ejection chamber 52 as compared to the distance of the fluid pump 64 to the fluid output hole 62. The positioning of each respective fluid pump 64 may be described as being asymmetrically arranged in the fluid output channel 60.

Figure 4:
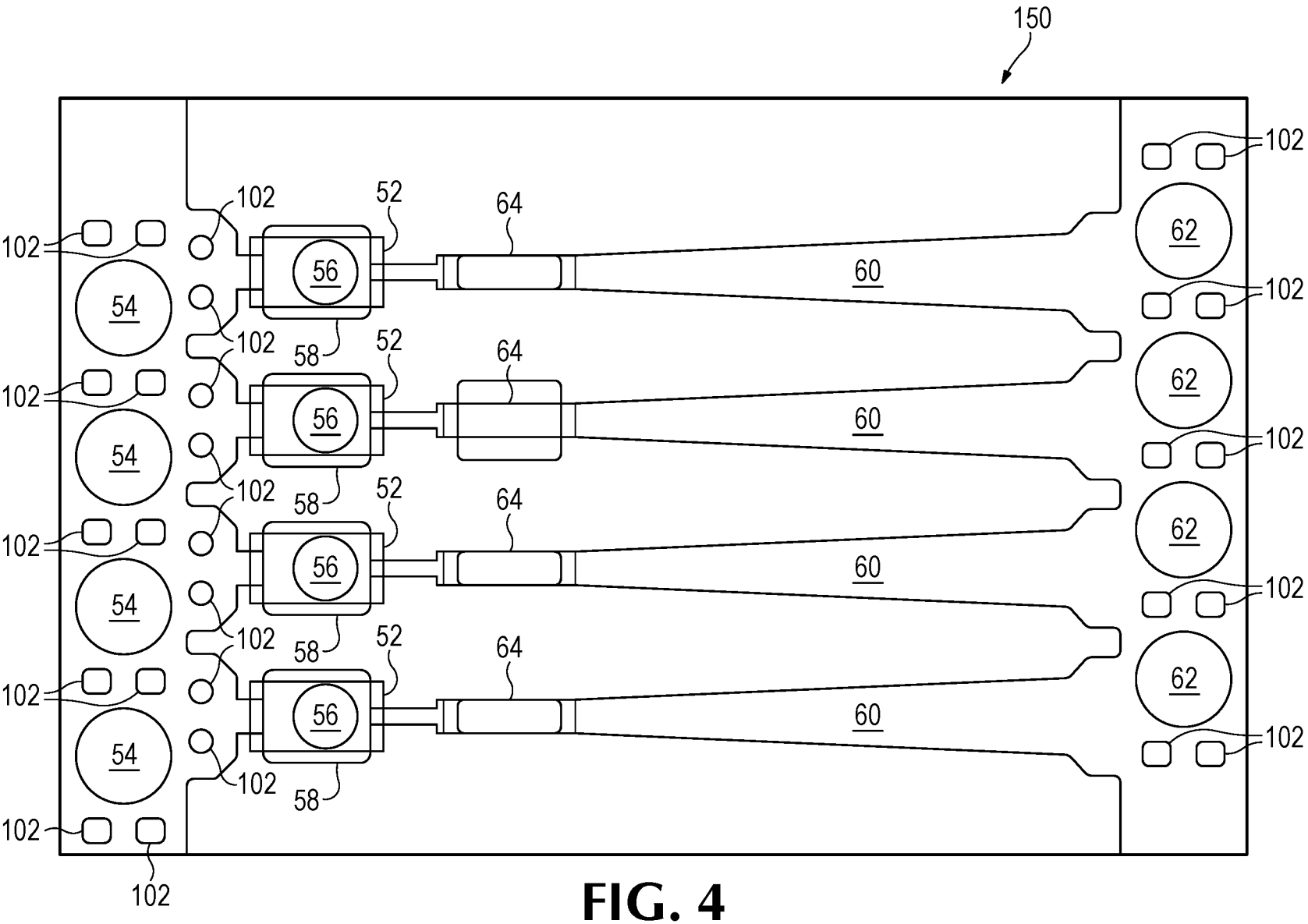
FIG. 4 is a block diagram of some components of an example fluid ejection die.

FIG. 4 provides a block diagram that illustrates some components of an example fluid ejection device and/or a fluid ejection die thereof. Similar to the examples of FIGS. 2A-D and 3, the example fluid ejection die 150 includes ejection chambers 52, fluid input holes 54, ejection nozzles 56, fluid ejectors 58, fluid output channels 60, fluid output holes 62, fluid pumps 64, and pillars 102. In the example of FIG. 4, each respective fluid output channel 60 may be fluidly connected to the respective ejection chamber 52 at a first end and the respective fluid output hole 62 at a second end. As shown, a channel width of each fluid output channel 60 (which corresponds to a channel radius, channel diameter, and/or cross-sectional area of the channel) at the first end is less than a channel width of each fluid output channel 60 at the second end. Therefore, it may be appreciated that each respective fluid output channel 60 may be described as being tapered from the second end to the first end.

Figure 5:
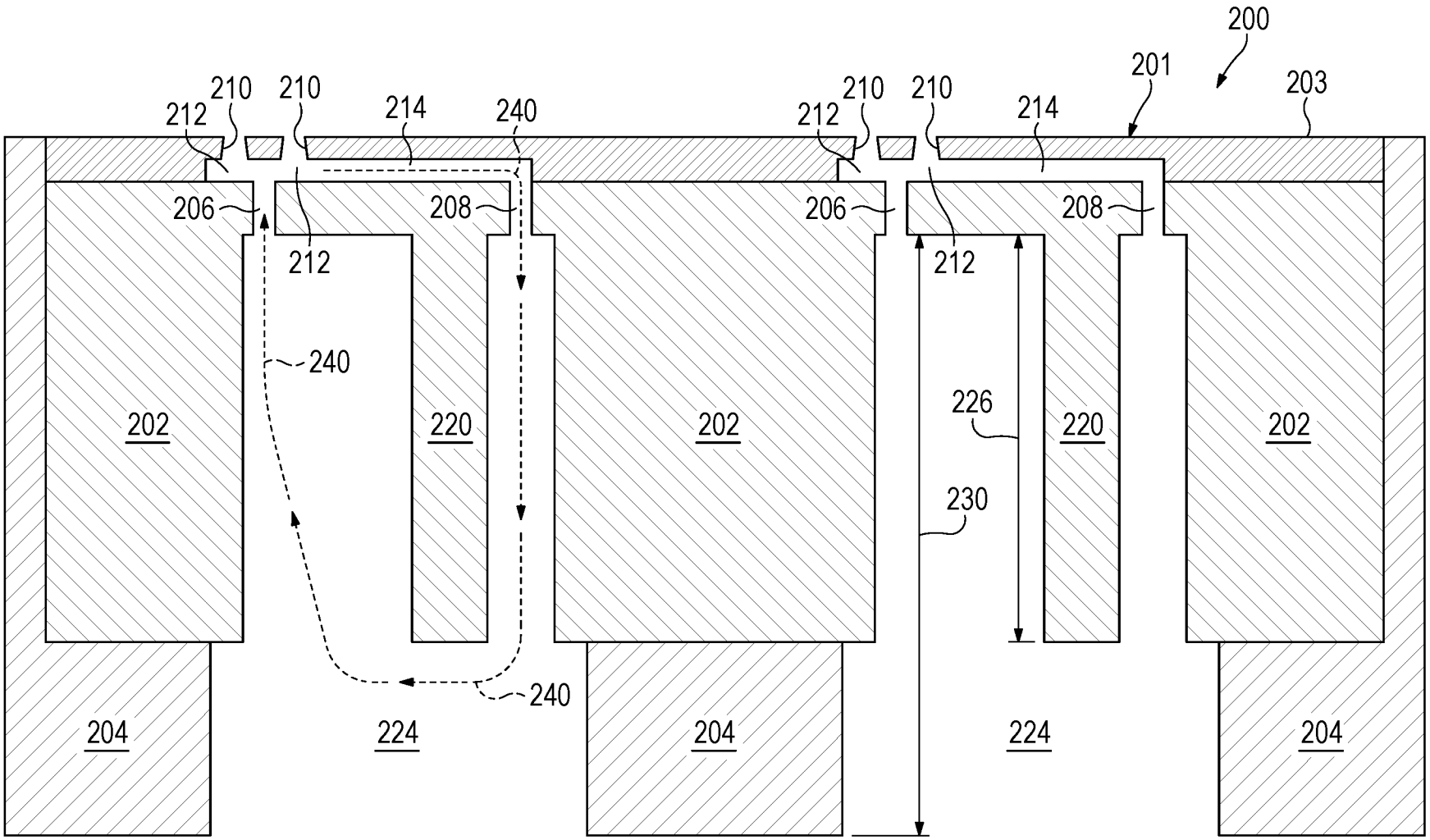
FIG. 5 is a block diagram of some components of an example fluid ejection device.

FIG. 5 provides a block diagram that illustrates some components of an example fluid ejection device 200. In this example, the fluid ejection device 200 comprises a fluid ejection die 201 that includes a substrate 202 and a nozzle layer 203. Furthermore, the fluid ejection device 200 comprises a molded panel 204 that may enclose portions of the fluid ejection die 201 and support the fluid ejection die 201. In some examples, the nozzle layer 203, substrate 202, and molded panel may be composed of different materials. For example, the nozzle layer 203 may be formed of a polymer material; the substrate 202 may be formed of silicon; and the molded panel may be formed of an epoxy material. In some examples a top surface of the fluid ejection device 200 may be composed of a top surface of the nozzle layer 203 and a top surface of the molded panel 204, where the top surface of the fluid ejection device 200 may be approximately planar.

The example die 201 includes fluid input holes 206 and fluid output holes 208 formed through the substrate layer 202. Furthermore, the example die 201 comprises ejection nozzles 210 formed through the nozzle layer 203 As described with regard to other examples, the fluid ejection die 201 further includes a respective ejection chamber 212 formed in the substrate 202 and/or nozzle layer 203 adjacent to and fluidly connected with each respective nozzle 210. A respective fluid output channel 214 fluidly connects each respective ejection chamber 212 to a fluid output hole 208. While not shown in this example, it will be appreciated that the ejection die 200 may comprise a fluid ejector disposed in each respective ejection chamber 212 to eject fluid drops out of the ejection chamber 212 via the respective ejection nozzle 210. Furthermore, the example fluid ejection die 200 may comprise a fluid pump disposed in each fluid output channel 214 to pump fluid from the respective ejection chamber 212 to the respective fluid output hole 208.

In addition, the example fluid ejection die 200 comprises a fluid circulation rib 220. As shown, the fluid circulation rib 220 extends in a plane that is generally orthogonal to a plane in which the fluid output channels 214 are arranged. The molded panel 204 and the substrate 202 may have a fluid slot 224 formed therethrough and fluidly connected to the fluid input holes 206 and the fluid output holes 208. As shown in the example, each fluid circulation rib 220 extends into the fluid slot 224 a distance that may be described as a fluid circulation rib height 226. In some examples, the fluid circulation rib height 226 may correspond to a fluid slot depth 230. For example, the fluid circulation rib height 226 may be approximately 50% the fluid slot depth 230. In other examples, the fluid circulation rib height 226 may be approximately 25% the fluid slot depth 230. In some examples, the fluid circulation rib height 226 may be in a range of approximately 5% of the fluid slot depth 230 to approximately 90% of the fluid slot depth 230.

In FIG. 5, a general fluid flow direction 240 is illustrated with dashed arrows. Notably, fluid may flow into the ejection chambers 212 from the fluid slot 224 via the fluid input holes 206. As discussed previously, fluid may be ejected from the ejection chambers 212 via the respective nozzles 210, or fluid may be pumped from the ejection chambers 212 out of the fluid output holes 208 via the fluid output channels 214. In this example, fluid may be pumped out of the fluid output holes 208 back into the fluid slot 224, where the respective fluid circulation rib 220 may inhibit flow of output fluid back into the fluid input holes 206 by providing a barrier therebetween.

Figure 6:
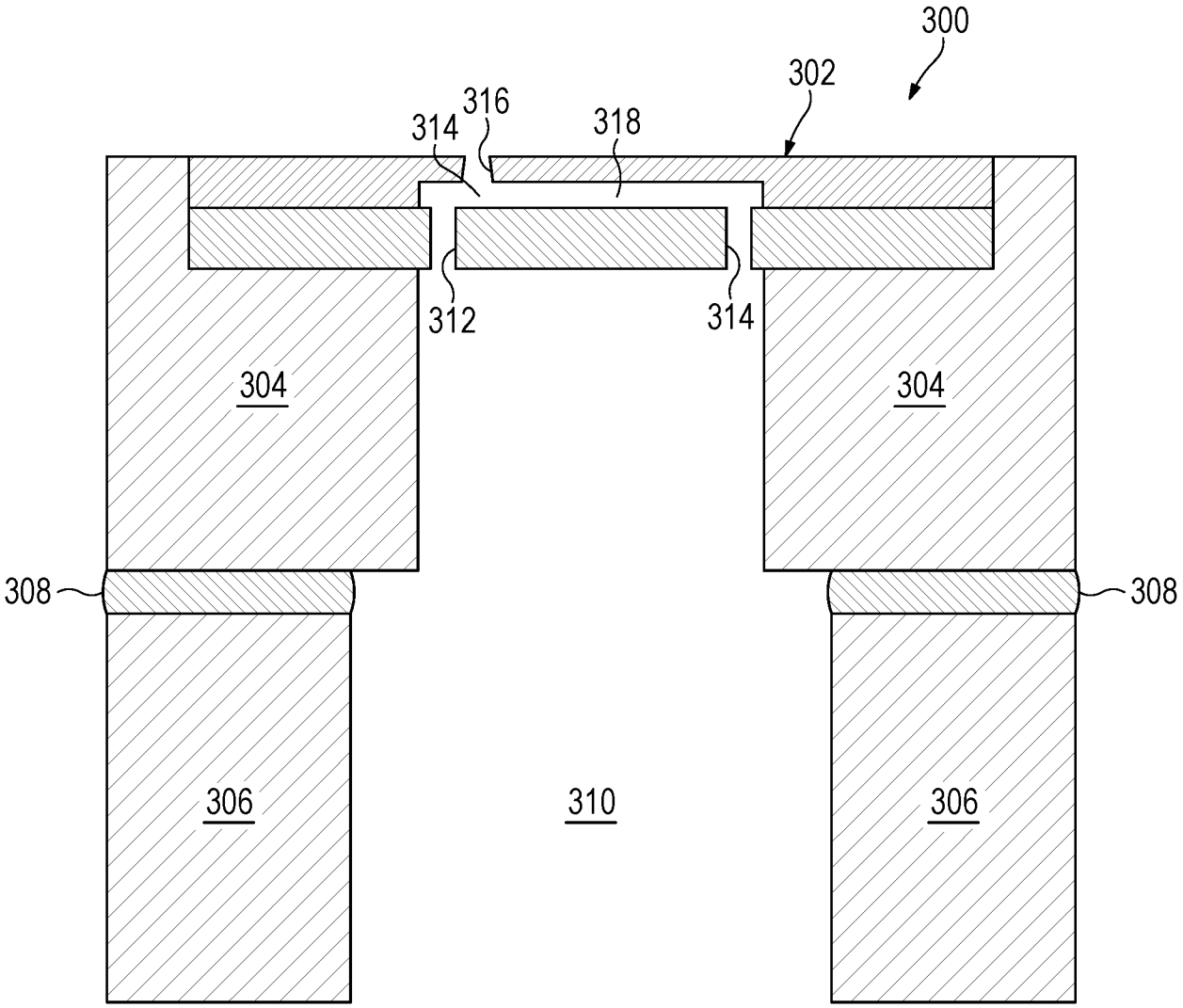
FIG. 6 is a block diagram of some components of an example fluid ejection device.

FIG. 6 illustrates an example fluid ejection device 300 comprising a fluid ejection die 302, a molded panel 304 and a carrier 306. In this example, the fluid ejection die 302 is at least partially embedded in and at least partially enclosed by the molded panel 304. The molded panel may be coupled to the carrier 306 with an adhesive 308. As shown in this example, a fluid slot 310 may be formed through the carrier 306, adhesive 308, and molded panel 304. The fluid slot is fluidly connected to a fluid input hole 312 and a fluid output hole 314 of the fluid ejection die 302. The fluid input hole 312 of the fluid ejection die 302 is fluidly connected to an ejection chamber 314. The ejection chamber 314 is fluidly connected to a nozzle 316 through which drops of fluid may be ejected. In addition, the ejection chamber 314 is fluidly connected to a fluid output channel 318. In turn, the fluid output channel 318 is fluidly connected to the fluid output hole 314. As described in previous examples, fluid of the ejection chamber may be pumped from the ejection chamber 314 back into the fluid slot 310 through the fluid output channel 318 and the fluid output hole 314.

Figure 7:
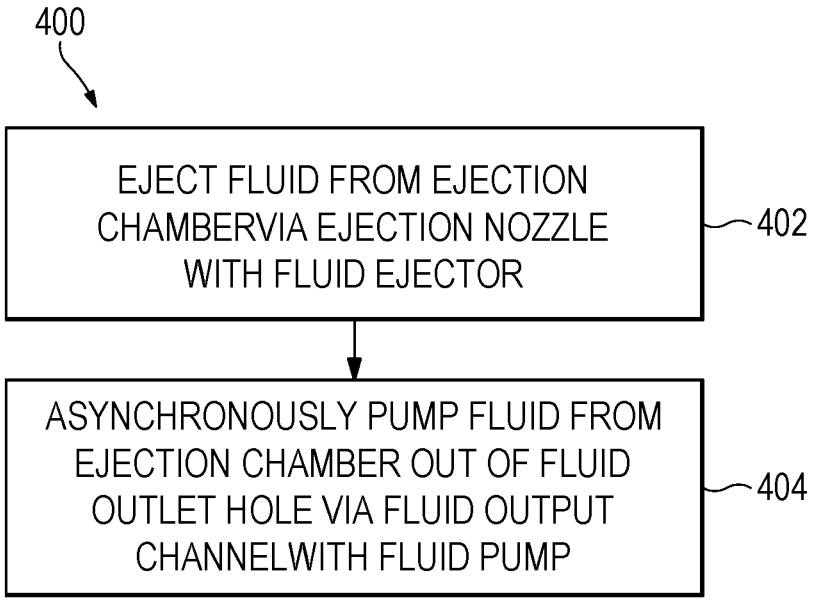
FIG. 7 is a flowchart of an example process.

Turning to FIG. 7, a flowchart 400 is provided that illustrates an example sequence of operations that may be performed by an example fluid ejection device and/or a fluid ejection die thereof. As discussed with regard to previous examples, fluid may be ejected from an ejection chamber via an ejection nozzle with a fluid ejector (block 402). Asynchronous with ejection of fluid with the fluid ejector, fluid may be pumped from the ejection chamber out of a fluid outlet hole via a fluid output channel with a fluid pump (block 404). Therefore, it will be appreciated that in examples similar to the example of FIG. 7, operation of the fluid ejector and the fluid pump may be asynchronous—i.e. not concurrent.

Accordingly, examples provided herein may provide a fluid ejection die including a fluid input hole fluidly connected to an ejection chamber. The ejection chamber may be adjacent to and fluidly connected to an ejection nozzle such that fluid may be ejected out of the ejection chamber via the ejection nozzle. In addition, the ejection chamber may be fluidly connected to a fluid output channel, and the fluid output channel may be fluidly connected to a fluid output hole. Fluid may be pumped from the ejection chamber out of the fluid output hole via the fluid output channel to thereby facilitate circulation of fluid. As will be appreciated, circulation of fluid therewith may reduce particulate settling in the ejection chamber. In addition, circulation of fluid therewith may facilitate thermal cooling of components and surfaces proximate the ejection chamber.

The preceding description has been presented to illustrate and describe examples of the principles described. This description is not intended to be exhaustive or to limit these principles to any precise form disclosed. Many modifications and variations are possible in light of the description. Therefore, the foregoing examples provided in the figures and described herein should not be construed as limiting of the scope of the disclosure, which is defined in the Claims.

The invention claimed is:

1. A fluid ejection die comprising:
an ejection nozzle formed in a layer;
an ejection chamber formed in the layer and fluidly connected to the ejection nozzle;
a fluid input hole formed in a substrate adjacent to the layer and fluidly connected to the ejection chamber;
a fluid output hole formed in the substrate;
a fluid slot formed in the substrate and in a panel adjacent to the substrate and fluidically connected to the fluid input hole and the fluid output hole;
a fluid output channel formed in the layer and fluidly connected to the ejection chamber and the fluid output hole; and
a fluid circulation rib formed in the substrate and extending into and positioned in the fluid slot between a position directly below the ejection nozzle and a position directly below the fluid output hole.

2. The fluid ejection die of claim 1, further comprising:
a fluid ejector disposed in the ejection chamber to eject fluid via the ejection nozzle.

3. The fluid ejection die of claim 1, wherein the fluid circulation rib partially extends into the fluid slot.

4. The fluid ejection die of claim 1, wherein the fluid circulation rib directs fluid output from the fluid output hole into the fluid slot, and directs the fluid from the fluid slot into the fluid input hole.

5. The fluid ejection die of claim 1, wherein the fluid circulation rib is positioned closer to the fluid output hole than the fluid input hole.

6. The fluid ejection die of claim 1, wherein the fluid circulation rib inhibits drawing of fluid through the fluid input hole that was output from the fluid output hole until the fluid has passed a termination point of the fluid circulation rib.

7. A fluid ejection device comprising:
an ejection nozzle formed in a layer;
an ejection chamber formed in the layer and fluidly connected to the ejection nozzle;
a fluid input hole formed in a substrate adjacent to the layer and fluidly connected to the ejection chamber;
a fluid output hole formed in the substrate;
a fluid slot formed in the substrate and in a panel adjacent to the substrate and fluidically connected to the fluid input hole and the fluid output hole;
a fluid output channel formed in the layer and fluidly connected to the ejection chamber and the fluid output hole; and
a fluid circulation rib formed in the substrate and extending into and positioned in the fluid slot between a position directly below the ejection nozzle and a position directly below the fluid output hole,
wherein first and second sidewalls of the substrate define the fluid slot therebetween,
wherein first and second sidewalls of the panel further define the fluid slot therebetween, the slot having a greater width between the first and second sidewalls of the panel than between the first and second sidewalls of the substrate.

8. The fluid ejection device of claim 7, further comprising:
a fluid ejector disposed in the ejection chamber to eject fluid via the ejection nozzle.

9. The fluid ejection device of claim 7, wherein the fluid circulation rib has a termination point in a portion of the fluid slot defined by the substrate and not by the panel.

10. The fluid ejection device of claim 7, wherein the fluid circulation rib partially extends into the fluid slot.

11. The fluid ejection device of claim 7, wherein the fluid circulation rib directs fluid output from the fluid output hole into the fluid slot, and directs the fluid from the fluid slot into the fluid input hole.

12. The fluid ejection device of claim 7, wherein the fluid circulation rib is positioned closer to the fluid output hole than the fluid input hole.

13. The fluid ejection device of claim 7, wherein the fluid circulation rib inhibits drawing of fluid through the fluid input hole that was output from the fluid output hole until the fluid has passed a termination point of the fluid circulation rib.

14. A fluid ejection device comprising:
a plurality of ejection nozzles formed in a layer;
a plurality of ejection chambers formed in the layer and fluidly connected to the ejection nozzles, respectively;

a plurality of fluid input holes formed in a substrate adjacent to the layer and fluidly connected to the ejection chambers, respectively;

a plurality of fluid output holes formed in the substrate respectively corresponding to the ejection chambers;

a plurality of fluid slots formed in the substrate and in a panel adjacent to the substrate and that are each fluidically connected to a respective one of the fluid input holes and a respective one of the fluid output holes;

a plurality of fluid output channel formed in the layer and that are each fluidly connected to a respective one of the ejection chambers and a respective one of the fluid output holes; and a plurality of fluid circulation ribs formed in the substrate and that each extending into and positioned in a respective one of the fluid slots between a position directly below a respective one of the ejection nozzles and a position directly below a respective one of the fluid output holes.

15. The fluid ejection device of claim 14, further comprising:

a plurality fluid ejectors respectively disposed in the ejection chambers to eject fluid via respective of the ejection nozzles.

16. The fluid ejection device of claim 14, wherein each fluid circulation rib partially extends into the respective one of the fluid slots.

17. The fluid ejection device of claim 14, wherein each fluid circulation rib directs fluid output from the respective one of the fluid output holes into the respective one of the fluid slots, and directs the fluid from the respective one of the fluid slots into the respective one of the fluid input holes.

18. The fluid ejection device of claim 14, wherein each fluid circulation rib is positioned closer to the respective one of the fluid output holes than to the respective one of the fluid input holes.

19. The fluid ejection device of claim 14, wherein each fluid circulation rib inhibits drawing of fluid through the respective one of fluid input holes that was output from the respective one of the fluid output holes until the fluid has passed a termination point of the fluid circulation rib.

* * * * *